United States Patent [19]

Brearley

[11] 4,415,198

[45] Nov. 15, 1983

[54] SEAT FOR INVALID WALKER

[76] Inventor: Gordon D. Brearley, P.O. Box 8335, Alta Vista Terminal, Ottawa, Ontario, Canada, K1G 3H8

[21] Appl. No.: 208,071

[22] Filed: Nov. 18, 1980

[51] Int. Cl.[3] ..... A61H 3/04; A63C 3/04

[52] U.S. Cl. ..... 297/6; 297/441

[58] Field of Search ..... 297/6, 441, 16, 45; 248/431, 432

[56] References Cited

U.S. PATENT DOCUMENTS

| | | | |
|---|---|---|---|
| 188,885 | 3/1877 | Frederick | 297/6 |
| 673,100 | 4/1901 | Tyler | 297/5 |
| 989,966 | 4/1911 | Hayden | 297/6 |
| 1,285,580 | 11/1918 | Bachtel | 248/432 X |
| 1,448,783 | 3/1923 | Blewitt et al. | 297/6 |
| 1,832,676 | 11/1931 | White et al. | 297/45 |
| 2,129,260 | 9/1938 | Bowser | 297/6 |
| 2,433,969 | 1/1948 | Wood | 297/6 |
| 2,759,525 | 8/1956 | Ries | 155/22 |
| 2,798,533 | 7/1957 | Frank | 155/22 |
| 3,136,272 | 6/1964 | Sprigman | 297/45 |
| 3,354,893 | 11/1967 | Schmerl | 135/45 |
| 3,384,148 | 5/1968 | Sarginson et al. | 297/DIG. 2 |
| 3,532,356 | 10/1970 | Lillibridge | 248/431 X |
| 3,633,906 | 1/1972 | Fowler | 272/70.3 |
| 3,993,349 | 11/1976 | Neufeld et al. | 297/6 |
| 4,162,101 | 7/1979 | McCaque, Sr. et al. | 297/6 |

FOREIGN PATENT DOCUMENTS

| | | |
|---|---|---|
| 210961 | 4/1921 | Canada . |
| 213958 | 10/1921 | Canada . |
| 273615 | 9/1927 | Canada . |
| 516222 | 9/1955 | Canada . |
| 1465277 | 2/1977 | United Kingdom . |
| 1498895 | 1/1978 | United Kingdom . |

*Primary Examiner*—Francis K. Zugel

[57] ABSTRACT

A portable seat for mounting on an invalid walker enabling a walking invalid to sit and rest until strength is recovered sufficiently to continue walking. The seat comprises a rectangular, foldable sheet of material of sufficient strength to support a person. The seat can be readily attached to the walker for seating to rest and readily detached for carrying on the person in pocket or purse for walking. The seat is adjustable in one or more respects and can be mounted on the more complex of common walkers, such as some foldable swinging walkers, without making holes in or structural changes to frame members. Four hooks are detachably connected to respective frame members by means of ordinary hose clamps. A metal ring is attached to the sheet at each corner thereof and the sheet is attached to the walker by placing each ring on a respective hook. The seat can be manufactured from readily available common parts and installed using common skills and tools.

4 Claims, 5 Drawing Figures

FIG. 2
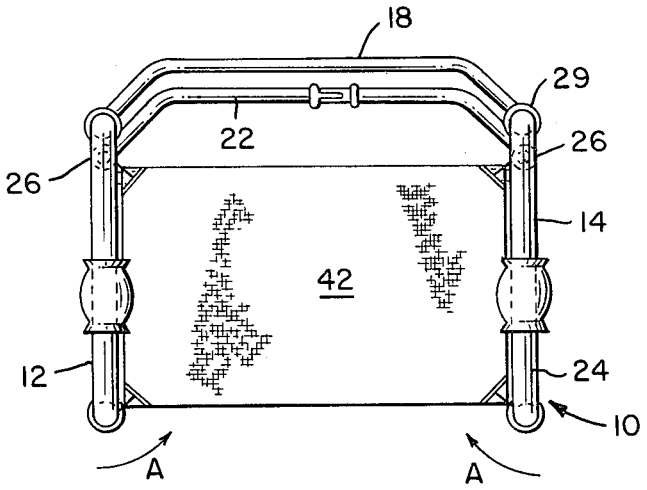
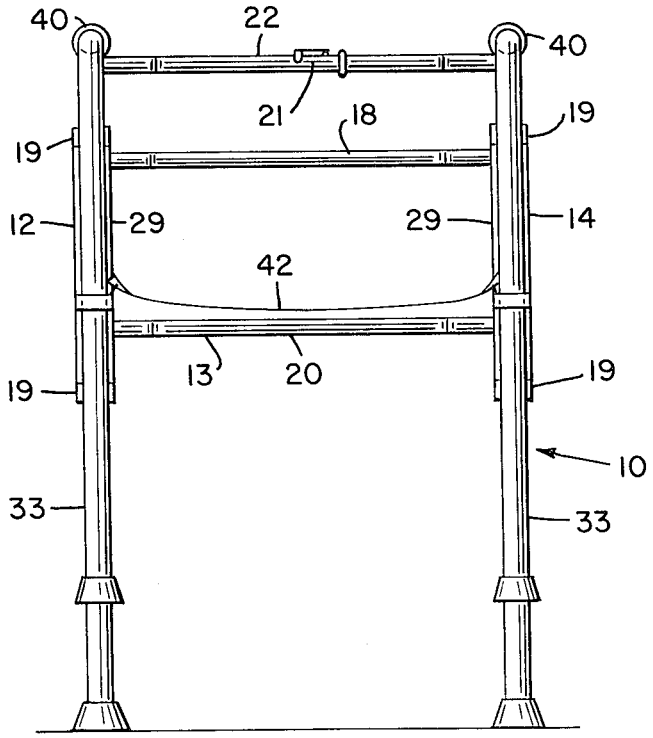
FIG. 1

FIG. 4
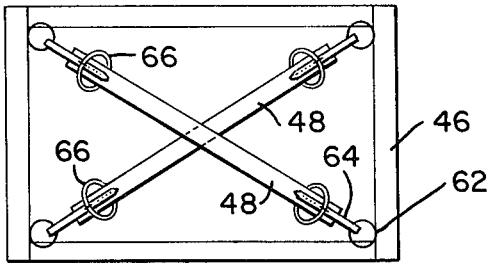
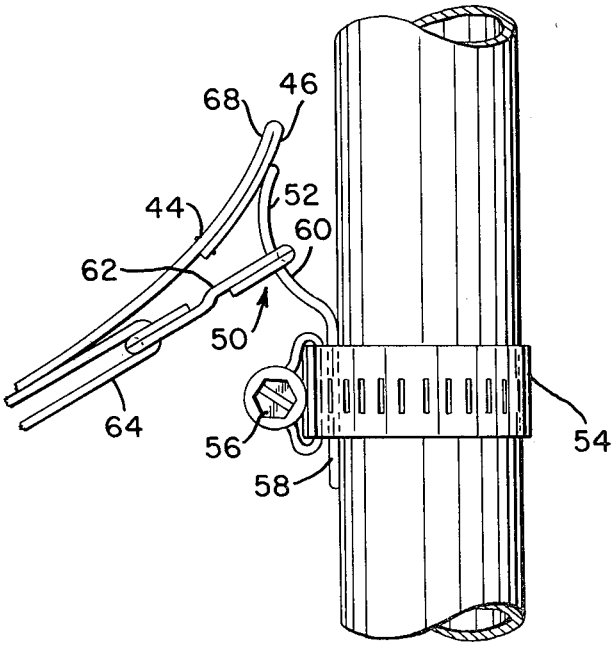
FIG. 5

SEAT FOR INVALID WALKER

BACKGROUND OF THE INVENTION

This invention relates to portable seats and particularly seats adapted for use on invalid supporting devices.

Various portable supporting frames are known which enable or assist handicapped, invalid, or infirm persons to walk. These frames or "walkers" assist a person who has difficulty in walking to keep his balance and they also enable part of the invalid's weight to be supported by his arms.

The more common of invalid support frames are basically the same in their operation and construction although there are minor differences in configuration and in their dimension. Common walkers consist of a multi-legged lightweight rigid frame that supports two handles at about waist level. The invalid operates the device by grasping the two handles, lifting and moving it forward, and then holding onto it for balance and support while he steps into the cavity. He repeats these motions to proceed. Recently developed walkers can be folded into a relatively compact form when not in use. Folding walkers are particularly advantageous from several standpoints. They require less room when being shipped to stores or customers and less space is required to store them either in the home or in the store. They are also much more portable when travelling on public transit vehicles or in private cars.

Another recent and important development in invalid support frames has been the use of semi-flexible or "swinging walkers". These walkers are constructed with hinged joints at the corners where the two, spaced apart side frames meet the connecting front frame members. When these walkers are used by an invalid, two feet of the walker can be maintained on the ground at all times and permit the user the option to lift less weight. Also it is known to provide a walker that is both foldable and swinging.

It is also known to provide walkers with a temporary seating arrangement so that if a user should become tired he will have a seat readily available. It will be appreciated that many invalid persons become tired quite easily and it is important that such persons not overexert themselves.

One such seating arrangement is shown in U.S. Pat. No. 3,993,349 dated Nov. 23, 1976 and issued to Neufeld et al. In the walker of this patent, the temporary seat is constructed from a sling of canvas or other flexible material. The seat which is quite narrow has a loop formed at each end so that each end can be supported by a T-shaped bar. The upper end of each T-shaped bar is bent so that the bar can engage in a specially designed metal block. The construction taught by the patent requires specialized metal parts which increase the cost of the seat arrangement. In addition carrying the seat on the person when not in use would be cumbersome since the metal T-shaped members can not be folded. Also, the seat taught by this patent distributes the weight of the invalid over a relatively small area of the body which could cause discomfort. Furthermore the seat arrangement is such that a weak and disabled person might feel insecure in the seat and he might in fact easily slip out of the sling and injure himself.

More recent U.S. Pat. No. 4,162,101 dated July 24, 1979 issued to McCague Sr. and Elinore M. McCague teaches the use of a seat in the cavity formed by a walker. The seat is designed to automatically swing up and out of the way when seating is not desired. The seat of this U.S. patent requires a number of specialized mechanical parts which would make it relatively costly. The seat is also heavier and more cumbersome for an invalid to transport than the seat proposed by the present invention.

It is an object of the present invention to provide an invalid seat which can be used on known walkers and which is inexpensive and highly portable.

It is a further object of the invention to provide an invalid seat which will provide a comfortable and secure seat for the user and which also can be folded up into a compact configuration when not being used.

It is another object of the invention to provide an inexpensive invalid seat that can be mounted on a support apparatus in such a manner that its height above the ground is readily adjustable.

SUMMARY OF THE INVENTION

According to one aspect of the present invention, a portable seat for mounting on a support frame constructed with frame members comprises a rectangular, foldable sheet of material of sufficient strength to support a person. Four hook means and cooperating eye means for separately connecting each corner of the sheet to a respective frame member are provided. One of said hook means and eye means is attached to the sheet at each of the four corners thereof. The other of said hook means and eye means are provided with devices for detachably attaching each of the four hook or eye means to a respective frame member.

According to another aspect of the invention, there is provided an invalid seat for mounting on an invalid support apparatus used to support a walking invalid. The seat comprises a multi-sided, foldable sheet of material and means attached to the sheet at each corner for connecting the corner to a respective vertical frame member forming part of the support apparatus. Adjustable connectors are provided for detachably engaging each connecting means and each connector is adapted to clamping onto a respective frame member at a selected height so that the height above the ground of the invalid seat can be varied as desired.

The advantages of the portable seat of the invention will be readily apparent. Because the sheet of material can be folded into a compact configuration, it could be stored in a pocket or purse for easy transport. This feature is particularly advantageous for the user of the walker travelling by public transit vehicles where there is no safe place where the seat can simply be laid down for transit. Thus the seat of the invention may remove any unnecessary restriction to an invalid's or handicapped person's mobility and may enable such people to increase the size of the area across which they feel they can travel on their own.

Another advantage of the preferred portable seat arrangement disclosed herein is that the seat can be constructed using simple, readily available metal parts. Thus the cost of the preferred seat construction is quite low. Also the preferred portable seat described herein is adjustable in one or more respects. The height of the seat above the ground can be varied by loosening, shifting, and then tightening a clamping device used to connect each corner to an adjacent frame member. In addition the effective size of the foldable sheet for fastening purposes can be varied so that a single type of foldable sheet can be manufactured which will fit walkers of different sizes and differing construction.

A preferred embodiment of the invention will now be described in detail, by way of example, with reference to the accompanying drawings.

BRIEF DESCRIPTION OF THE DRAWINGS

FIG. 1 is a rear view of an invalid support apparatus provided with a foldable seat;

FIG. 2 is a top view of the support apparatus of FIG. 1;

FIG. 4 is a view of the bottom side of the foldable sheet used to provide a seat on the support apparatus; and FIG. 5 is a detailed view showing how each corner of the foldable sheet is connected to an adjacent frame member.

DETAILED DESCRIPTION OF PREFERRED EMBODIMENT

Figure 3:
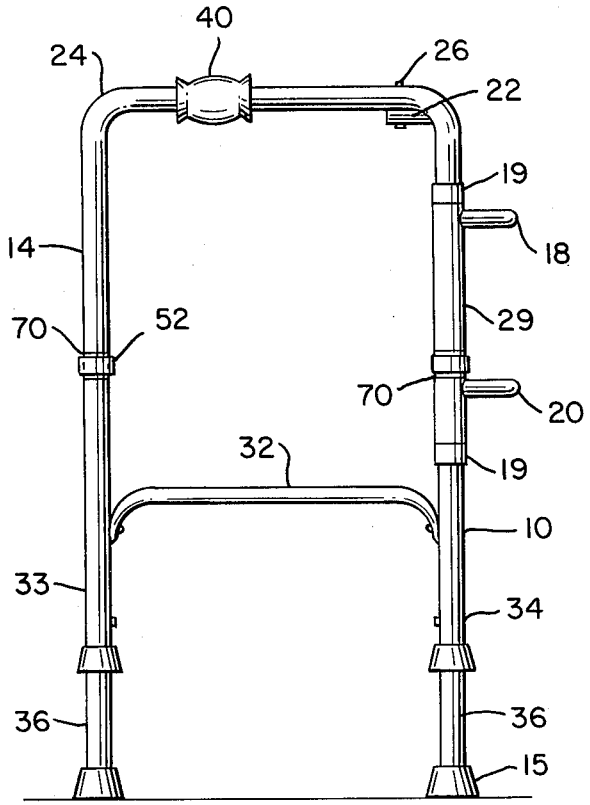
FIG. 3 is a right side view of the support apparatus of FIG. 1 with the seat removed.

An invalid support apparatus 10, modified in accordance with the teachings of the present invention is shown in FIGS. 1 to 3. The apparatus consists of 3 connected lightweight rigid frames. Two identical spaced apart side frames 12 and 14, one on each side, are connected together by a third frame 13 in front. Each side frame has the configuration of an inverted U with a handgrip 40 on its top horizontal member 24, a horizontal brace 32 just below knee level, and a foot 15 on each vertical member. If desired the height above the ground of the two handgrips can be adjusted for maximum comfort and safety by providing telescoping legs 36 on each vertical side frame member 33 and 34. The third frame 13, in front, consists of two vertical side members 29 of internal diameter slightly larger than the outside diameter of the vertical front members 34 of the two side frames and rigidly joined by two horizontal members 18 and 20. The vertical front member 34 of each side frame passes through a respective vertical member 29 of the front frame. The front frame 13 is retained in the required position on the side frames by two sleeves 19 attached to each front member 34 of each side frame by pop rivets.

It will be appreciated that with this construction a desirable hinge arrangement is provided that enables the two side frames 12 and 14 to be folded in the direction shown by the arrows A in FIG. 2 into an area whose limits are defined by the front frame for convenient storage and shipping. When used in the walking position, the two side frames 12 and 14 are connected together at their top members 24 by means of a curved telescoping horizontal member 22 that can be locked open in the walking position by means of a lock button 21. The telescoping curved horizontal member 22 is connected by means of a nut and bolt 26 to the top member of each side frame so that it permits a limited swinging action of one side frame about the other side frame. This swinging action permits the walking invalid the option to maintain two side feet on the ground at all times and, when pivoting the two swinging legs vertically around the two supporting legs, to be lifting only a small portion of the total weight of the walker. It will of course be appreciated that walkers can be and are manufactured using a variety of configurations and dimensions. Further description of the support apparatus per se is unnecessary as such apparatus are known. Each employs two spaced apart side handles that can be gripped to provide a firm support to assist an invalid when walking.

The present invention improves the support apparatus described above by providing a lightweight, compact, and easily transportable temporary seat for use on the support apparatus. The seat 42 includes a rectangular, foldable sheet of material that can be constructed either of fabric or strong, flexible plastic sheeting. The preferred material is canvas and particularly number 14 duck canvas which is hemmed on all sides. The hems are formed by folding over each edge and stitching the folded material as at 44 shown in FIG. 5. Each hem 46 is of course formed on the bottom of the foldable sheet.

If desired, the foldable sheet can be reinforced for extra strength by means of two strips 48 of material, each strip extending between opposite corners of the rectangular sheet. The strips or straps are sewn onto the bottom surface of the sheet and they are preferably made of a tough fabric such as canvas.

A hook and eye means or mechanism 50 shown in detail in FIG. 5 is provided for detachably and separately fastening each corner of the sheet to a respective one of the frame members. In the preferred embodiment illustrated, each corner is connected to a tubular, vertically extending frame member forming part of a side frame. When the seat is mounted with the use of the hook and eye means, the seat extends generally between the two side frames 12 and 14 as shown in FIGS. 1 and 2. With the use of these preferred fasteners and the aforesaid reinforcing strips 48 most of the weight of an invalid is supported on and transferred directly in tension uniformly to the four vertical support members.

Turning now to the preferred construction of the hook and eye means used to attach the sheet of material, these means include hooks 52 rigidly connected to respective frame members by means of clamps 54 formed with metal straps. The hooks 52 and clamps 54 add relatively insignificant weight and bulk to the support apparatus. The clamps can be in the form of known hose clamps which employ a threaded member or bolt 56 which can be turned by means of a screwdriver or wrench and can be used to tighten or loosen the clamp. Each hook 52 includes a straight lower portion 58 and a curved upper portion 60. The lower portion 58 is firmly clamped against the side of the adjacent frame member by means of the hose clamp 54.

Another part of the hook and eye means is provided by a ring 62 attached to a reinforcing support strap 48 of the sheet 42 adjacent each corner of the sheet. Each of the four rings can comprise a common "split-ring" often used to hold keys for locks. Each ring 62 is preferably attached to the reinforcing support strap 48 by means of a connecting loop 64 formed at the end of the strap. The position of each ring 62 at the corner of the sheet can be made adjustable so that the sheet can fit on walkers of different sizes. This feature is provided by making the size of each loop 64 adjustable by means of a buckle 66 attached near each end of the reinforcing straps. The buckle engages holes formed in the material forming the loop 64 in a well known manner. Each ring is of course adapted to fit over a respective hook 52 in the manner shown in FIG. 5. Preferably the corner 68 of the sheet extends over the upper portion 60 of the hook to provide some protection from clothing catching on the hooks and becoming torn or damaged.

It will be appreciated that with the use of the adjustable clamps 54, the height of the seat above the ground can be raised or lowered as desired. Because the clamps 54 do not require holes in the frame members or any structural changes to the frame members, it will be appreciated that the adjustment in the height of each hook can be carried out without any weakening of or damage to the frame members. Also, it can be appreciated that such clamps will fit a variety of diameters of tubing. The hooks 52 can be the type commonly used to support room divider partitions and thus no special manufacturing process need be carried out to provide these hooks. If desired a tape can be wrapped around the frame member prior to attachment of each clamp 54. These tapes 70 which can be ordinary electrical insulation tape are illustrated in FIG. 3 and they act to increase the friction between the metal clamp and the metal of the frame member. They also retard corrosion of the metal parts in a moist environment.

According to one aspect of this invention, the hooks 52 and cooperating clamps 54 together provide adjustable connectors for detachably engaging the connecting means provided by the rings 62.

The foldable sheet can be provided in various sizes which will fit the different walkers being sold to the public. A typical size for a well known walker has a width which is at least equal to 60% of the length of the sheet. Thus the portable seat provided is quite deep and provides a firm, stable seat in which the user is likely to feel secure. The sheet is readily mounted on the more complex of common walkers such as a folding, swinging walker.

For some walkers, the flexible seat can have a trapezoidal configuration. For example, the forward edge could have a length of only 14 inches and the rearward edge a length of 20 inches. In this embodiment the width of the seat could be 13 inches. The flexible seat and the fittings should be sufficiently strong to support the weight of most persons. A flexible sheet and fittings which will not be damaged by a weight of 250 pounds are preferred.

In order to support heavier people on a walker of sufficient strength, each hook 52 can be strengthened by inserting another identical supporting hook behind it. Additionally a wrapping of sheet metal of greater width than the clamp 54 can be placed around the frame member prior to attachment of the clamp. The metal wrapping of this nature will act to distribute the load from the hook over a greater area of the frame member.

Although the drawings illustrate a walker constructed of tubular members which is the common form of frame member employed, it will be appreciated that the present invention is not restricted to use with walkers of this construction. The present invention can be adapted to walkers having frame members of different cross section and size or made with different materials than the usual material aluminum.

Other froms of hook and eye means, other than the specific forms illustrated, might of course be employed. For example in place of the rings 62 one might employ chain or rope loops of sufficient strength.

It will be appreciated that the preferred seat construction described herein has a number of distinct advantages, some of which have already been referred to. It can be readily adjusted and repaired, if necessary by the use of common skills and tools. The preferred foldable seat is resistant to deterioration, wear, and breakage. Because of its minimal complexity, weight, and bulk, it can be manufactured and distributed at a very low cost. The parts and materials required are readily available at minimal cost both to manufacturers and to consumers who may wish to purchase parts as spares or for repairs.

I claim:

1. An invalid support apparatus readily convertible by a person using the apparatus between a first configuration in which it serves as a walker and a second configuration in which it serves as a seat, comprising:

a. two side frames, each including forward and rearward upright rigid frame members;

b. a front frame including horizontal rigid frame members extending between the forward upright frame members, said side frames and front frame cooperating as a walker to support an invalid;

wherein the improvement comprises:

c. a plurality of clamping means, one for each of the upright frame members, each clamping means comprising a strap wrappable about a frame member, and means for tightening or loosening the strap, said clamping means being adjustable along its associated upright frame member to any selected position within a substantial range;

d. a sheet of material of sufficient strength to support a person and readily foldable by a person using the apparatus;

e. means readily operable by a person using the apparatus to connect the sheet to and detach it from the clamping means, said sheet and frames cooperating when the sheet is so connected to define a seat, said sheet being readily portable when detached, said connecting and detaching means including:

1. a plurality of hooks, each fixed on and extending upwardly from one of said clamping means, each hook being open at its upper end; and 2. a plurality of hook engaging and disengaging means readily operable by a person using the apparatus and affixed to spaced points on the sheet, said sheet and frames cooperating to form a seat when the hook engaging means are engaged with their respective hooks.

2. Apparatus for converting an invalid walker having two forward and two rearward upright rigid members between a first configuration in which it serves as a walker and a second configuration in which it serves as a seat, comprising:

a. a plurality of clamping means, one for each of the upright frame members, each clamping means comprising a strap wrappable about a frame member, and means for tightening or loosening the strap, said clamping means being adjustable along its associated upright frame member to any selected position within a substantial range;

b. a sheet of material of sufficient strength to support a person and readily foldable by a person using the walker;

c. a plurality of hooks, each fixed on and extending upwardly from one of said clamping means, each hook being open at its upper end; and d. a plurality of hook engaging and disengaging means readily operable by a person using the apparatus and affixed to spaced points on the sheet, said sheet and frame members cooperating to form a seat when the hook engaging means are engaged with their respective hooks.

3. The invalid support apparatus of claim 1 wherein said engaging and disengaging means comprise rings affixed to said spaced points on said sheet by means of adjustable connectors so that the position of each of said rings can be varied to facilitate the connection of said sheet to support apparatus of different sizes.

4. The apparatus of claim 2 wherein said engaging and disengaging means comprise rings affixed to said spaced points on the sheet by means of adjustable connectors so that the position of each of said rings can be varied to facilitate the connection of said sheet to invalid walkers of different sizes.

* * * * *